US007232354B2

(12) United States Patent
Olson et al.

(10) Patent No.: US 7,232,354 B2
(45) Date of Patent: Jun. 19, 2007

(54) INFLATABLE BUOYANCY DEVICE WITH WATER-DEPENDANT TRIGGERING MECHANISM

(76) Inventors: Manfred Bradley Olson, 1540-141 Harbor Dr. West, Oceanside, CA (US) 92054; Fredrick Spears, 655 Ann St., Oceanside, CA (US) 92057

( * ) Notice: Subject to any disclaimer, the term of this patent is extended or adjusted under 35 U.S.C. 154(b) by 0 days.

(21) Appl. No.: 11/447,410

(22) Filed: Jun. 6, 2006

(65) Prior Publication Data

US 2007/0089655 A1 Apr. 26, 2007

(51) Int. Cl.
*B63B 22/10* (2006.01)

(52) U.S. Cl. ..... 441/7; 441/8

(58) Field of Classification Search ..... 441/2, 441/7, 8, 95, 100, 101
See application file for complete search history.

(56) References Cited

U.S. PATENT DOCUMENTS 3,035,285 A * 5/1962 Squires, Jr. ..... 441/7
3,509,772 A * 5/1970 Blair ..... 73/864.31
4,493,664 A * 1/1985 Dale ..... 441/7
5,030,152 A * 7/1991 Carr et al. ..... 441/89
5,156,562 A * 10/1992 Pearson et al. ..... 441/8
5,163,858 A * 11/1992 Sumrall ..... 441/7

* cited by examiner

*Primary Examiner*—Stephen Avila
(74) *Attorney, Agent, or Firm*—Eric Hanscom

(57) ABSTRACT

This invention is directed toward a device which provides buoyancy to objects with negative buoyancy in water. The invention comprises a water-sensitive trigger which, when activated, causes a compressed gas to exit a canister and enter a balloon, which expands, thereby causing the object to float, in cases where the device is attached to an item on a boat, or rise to the surface, in cases where the device is attached to a sunken object. There are a number of variable characteristics, including canister size, trigger fuse length, balloon configuration, and housing material that allow a user tremendous flexibility in selecting a proper size of the invention for the user's intended purpose. Other iterations of the invention provide breathing air for underwater purposes and means of keeping cars, boats, airplanes, etc., floating when they fall into water.

25 Claims, 18 Drawing Sheets

INFLATABLE BUOYANCY DEVICE WITH WATER-DEPENDANT TRIGGERING MECHANISM

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

This invention is directed toward a device which provides buoyancy to objects with negative buoyancy in water. The invention comprises a water-sentitive trigger which when activated, causes a compressed gas to exit a canister and enter a balloon, which expands, thereby causing the object to float. There are two basic uses envisioned for the invention. First, the device can be attached to a negatively buoyant object, such as car keys or a windlass crank, which, if unsecured, can easily be lost over the side of a boat, such that hitting the water or sinking to a certain depth, the buoyancy device is activated and a balloon is filled with compressed gas which raises the object to the surface where the user can then easily and safely retrieve it. A second use of the device is for attachment to an already sunken object, where the device, when activated, will inflate a balloon, thereby causing the sunken object to float to the surface of the body of water in which it sank. There are two ways in which the invention can be used with an already sunken object: first, the device can be attached to the external surface of the object and inflated; second, the device can be secured inside a hold or other cavity of the object where, when inflated, it will not only supply buoyancy to lift the object, but also displace water which has filled the hold or cavity.

There are a number of variable characteristics, including canister size, trigger fuse length, balloon configuration, and housing material that allow a user tremendous flexibility in selecting a proper size of the invention for the user's intended purpose. Other iterations of the invention provide breathing air for underwater purposes and means of keeping cars, boats, airplanes, etc., floating when they fall into water.

Turning to the preferred embodiment of the invention, that of allowing a person to attach the device to non-buoyant objects likely to be lost overboard, one of the major problems facing boaters is the fact that there are many important unsecured objects on a boat which sink if dropped into the water. Common examples include keys, sunglasses, windlass cranks, various hand tools, anchors, and ropes. Once an object such as these, or any other object with negative buoyancy in water, falls into water, it will sink. In many cases, should the object be important, or, as in the case of keys to a boat's engine, essential to the safety of the excursion, the loss of an object would have catastrophic consequences.

Thus, there has existed for as long as humans have used boats on the water a need for a device which allows negatively buoyant objects to float on the water until the object can be retrieved.

The prior has several examples of attempts to resolve this problem. The most common is a plastic float which is usually attached to the negatively buoyant object by means of a keychain, such that if the object is dropped overboard the object will float. These floats, however, because they do not enlarge in size and volume with compressed air, must be large enough to float and object. Thus, as a practical matter they are limited to small objects such as keys; a plastic float large enough to keep a windless crank above water would have to be so large that it would be impractical to keep one attached to the windlass crank at all times.

Thus there has existed a long-felt need for a device which allows a user to attach a small, inexpensive, and lightweight device to a negatively buoyant object such that the object will not sink when it falls in water. The current invention provides just such a solution by having a device which provides buoyancy to objects with negative buoyancy in water. The invention comprises a water-sensitive trigger which, when activated, causes a compressed gas to exit a canister and enter a balloon, which expands, thereby causing the object to float upon the surface where the user can then easily and safely retrieve it. There are a number of variable characteristics, including canister size, trigger fuse length, balloon configuration, and housing material that allow a user tremendous flexibility in selecting a proper size of the invention for the user's intended purpose.

Another common problem relating to water occurs when an object sinks into a body of water and does not have a rope or other means of retrieval already attached to allow for easy retrieval. The object could be a solid object such as a boat anchor, or a larger object such as a car, truck, airplane, helicopter, train, or boat which fills with water and sinks. Recovering sunken boats and vehicles is extremely difficult, as the object, in addition to its substantial weight in metal and other negatively buoyant materials, has the additional weight of the water which fills each compartment, or hold, of the object. The main method by which sunken objects such as these are recovered is to attach a strong line to the sunken object, then try to lift the object back to the surface of whatever ocean, river, or lake it sunk into.

Thus, there has also existed a long-felt need for a device and method by which a small, solid sunken object or a large sunken object with holds or cavities can be brought back to the surface. The current invention provides such a solution by teaching an inflation device with a "long" fuse time and a tough balloon. One or more of the invention can be attached to a sunken object or inserted into the sunken object's hold or holds, either by SCUBA divers, submersibles, or remote control roving vehicles, and the long fuse allows sufficient time for the invention to be inserted. When the water finally eats through the long fuse, triggering the release of compressed gas, the balloon expands and either lifts the object to the surface or fills the hold, pushing out water and replacing the neutrally buoyant water with positively buoyant gas. If enough of the inflation devices are placed in the holds, eventually enough water will be forced out of the object and enough uncompressed gas will be trapped by the balloons inside the sunken object such that the object begins to float up to the surface on its own.

Another iteration of the invention calls for the invention to be manufactured such that it can be installed as part of the original manufacture in cars, trucks, helicopters, airplanes, trains, and boats, or retrofitted into existing objects, where the invention is located in all of the holds of a particular object. The purpose of the invention in this iteration is to provide a means of filling the holds before the water can completely fill the holds, and expelling that water which has already entered, thereby preventing the object from sinking.

For example, in an airplane the inventions could be positioned on the bottom of the cargo holds. If an airplane has to perform an emergency landing on a body of water, some water may begin to seep through into the cargo hold. Upon reaching the triggering devices, the water will set off the inflation process in which large balloons will very quickly fill to capacity, taking up all available space in the cargo holds and expelling the water that is already there. This would keep the airplane afloat for at least enough time for the passengers to evacuate safely.

Another example would be boats with holds. Had the Titanic had one of the inventions in each hold, the five holds which were initially damaged by the iceberg would have quickly been filled with a balloon rather than water, thereby, possibly keeping the boat afloat and at the very least given more passengers enough time to disembark safely. The invention is equally applicable to smaller boats, such as 20'–30' sailboats, which have at least several holds that could be effectively turned into flotation chambers by the invention.

A final problem that has plagued many water sports enthusiasts is the basic fact that humans do not have gills. As such, when a human is kept underwater for longer than a couple of minutes, the human usually dies. In sports such as SCUBA diving, kayaking, and big wave surfing, such submersions happen occasionally. Another iteration of the invention provides breathing air for underwater purposes. In this iteration, the canister contains compressed air, suitable for breathing. The trigger can be depth-sensitive or pressure-sensitive such that the inflation mechanism is triggered when the user exceeds a certain depth or has enough water on top of him/her that the triggering mechanism actives the inflation mechanism at certain pressures. The trigger can also have a variable length of fuse such that if a user has been submerged for a certain period of time, the trigger mechanism is eaten through by the water and the balloon is inflated, thereby carrying the user to the surface of the water.

SUMMARY OF THE INVENTION

It is a principal object of the invention to provide a mechanism by which a user of the invention can attach an inflatable buoyancy device with a water-triggering mechanism to an object, such as car keys, windlass cranks, or sunglass cases, which would normally sink into water, such that if the object was dropped into water, such as off a boat, the water would trigger the inflatable buoyancy device to inflate, thereby keeping the object at the surface of the water where it could be retrieved by the user.

It is another principal object of the invention to provide a mechanism by which a user of the invention can attached the device to an already sunken object and have a triggering mechanism which activates the buoyancy device at a certain depth or after a certain amount of time the device has been immersed in water, and use the buoyancy capacity of the device (or devices) to lift the sunken object.

It is another object of the invention that the inflation apparatus of the invention function with any compressed gas, including by not limited to air, carbon dioxide, helium, and nitrogen.

It is also an object of this invention that the inflatable unit can emit an alarm, sound (sonar pulse), Radio Frequency (RF) signals, audio signals, or other signals that could be tracked or traced by satellite or other means of tracking and tracing.

Another object of this invention is that the unit can, upon being triggered by immersion in water or any of the other possible triggering events, emit a light from a gas or laser (which is the excitement of a solid, liquid or gas) or be coated with a glow-in-the-dark substance which is activated upon triggering.

It is also an object of this invention that the unit can function to trigger responses from the dinoflagellates most commonly know as the organisms responsible for "Red Tides", such that the area surrounding the unit, upon triggering, becomes phosphorescent, thereby allowing the unit to be seen more easily or be detected by a sensor designed to detect dinoflagellate activity.

It is an additional object of the invention that the housing of the invention can be made from metal, plastic, wood, fiberglass, carbon fiber, treated paper, treated cardboard, rubber, resin, cement, and infused alloys.

It is a further object of the invention that the parts of the housing fit together using a wide variety of devices, including screw threads, snaps, zippers, Velcro®, glue, water-soluble glue and other water-soluble means of attachment, all types of materials that could be welded, slip fit attachments, compression and expansion fitted products, press fit, rivets, locking/interlocking, twist or turn-locking mechanisms, and vacuum forming devices.

It is also an object of this invention that the invention be manufactured in a wide range of sizes, with a wide range of inflation capacities, such a user can find an inflatable buoyancy device for virtually any item the user wishes to protect from sinking.

It is another object of the invention that the gas canisters which provide the flotation be readily exchangeable, such that a user can carry several backup canisters so that if the invention is used once, the user can exchange a full canister for the spent canister, thereby using the invention over and over again during one trip out over the water.

It is an additional object of the invention that the canisters can be manufactured with a wide variety of company logos and other advertising features such that they can be used for on-site promotional uses.

It is a further object of the invention that the fuse, or bobbin, portion of the invention can be manufactured with a wide variety of "fuse times", such that a user can select how long he/she wants to object to remain in the water before the inflation mechanism is triggered.

It is also an object of this invention that the invention be manufactured such that it either fit into a personal flotation device, or could be manufactured as part of a personal flotation device, so that when a user wearing such a PFD fell into the water, the inflation device would be triggered, thereby giving the user additional flotation.

It is another object of the invention that the trigger could be pressure-sensitive in addition to be water-sensitive, such that the inflation device would be triggered only when the user was in water at more than a certain pressure, such as a surfer who wiped out on a large wave being held under the water or a SCUBA diver who exceeded a certain depth.

It is an additional object of the invention that the triggering device could have a gradual reaction, such that it would release only enough compressed gas to raise a person to a certain depth without releasing all the compressed gas at once.

It is a further object of the invention that in a compressed air iteration of the invention, the invention would additionally comprise a breathing apparatus whereby the user could breath the air as it comes out of the canister, then exhale the spent air into a flotation device.

It is also an object of this invention that the invention, in an iteration in which the trigger has an extremely long "fuse time", can be used to float cars, boats, airplanes, helicopters and other objects which normally sink, where a SCUBA diver, submarine, or remote control ocean rover can implant the device in a hold of the sunken object and when the invention is triggered, the canister releases compressed gas into a balloon which then fills the hold, causing the object to become positively buoyant, such that the object rises to the surface.

It is another object of the invention that the use of the invention to float sunken objects can be used with multiple inflation devices all triggered by the same "fuse", all placed in different holds, such that a very large and heavy object can be raised.

It is an additional object of the invention that such "hold-filling" iterations can be installed in cars, trucks, boats, airplanes, helicopters, trains, and other transportation means which occasionally are lost in oceans, rivers, and lakes, such that once such an object falls into the water, the invention is triggered in one or more holds, thereby causing the normally negatively buoyant device to float, either permanently or at least long enough for the passengers to escape safely.

It is a further object of the invention that the balloon has a number of means of facilitating retrieval by the user, including an eye hook or other projection into which a gaff could be inserted.

It is also an object of this invention that an LED, Glowstick, or other illumination device be attached to the invention and triggered by immersion in water through the triggering apparatus, thereby providing a light source in addition to the flotation provided by the balloon.

It is another object of the invention that the illumination could operate off a small, waterproof battery which powers the illumination only upon water contact or upon the water triggering the inflation device.

It is an additional object of the invention that the illumination can flash, change colors, or otherwise attract attention through its appearance.

It is also an object of this invention that the invention may be built into mechanisms such as fishing rods, gaffs, nets, and other gear that may fall overboard and necessitate retrieval.

It is another object of the invention that a spring sealing diaphragm be included in its construction that controls activation due to pressure when submerged in liquid.

It is an additional object of the invention that the invention [it be fashioned to function as a marker or buoy when thrown overboard by utilizing a line and weight.

It is also an object of this invention that the invention have significant military applications, such as salvage, safety, and identification.

A further object of the invention is to facilitate the retrieval of important or vital items, such as black boxes on airliners, radios, life rafts, communication devices, survival kits and products, first aid kits, navigational devices, gps units, sextants, outboard motors, generators, anchors, tools and tool boxes, binoculars, monoculars, night vision devices, and flashlights.

An additional object of the invention is an iteration which can be manually activated for use in marking locations with a buoyant balloon, either in the water or on land, such as where search and rescue operations use helium in the canister.

The invention has further application in the crabbing and fishing industries, where a canister could be designed to be remote activated and raise pots or traps or lines.

Another object of the invention is found in fishing, SCUBA, river kayaking, or surfing suits that are two layers thick, where the device, when activated, allows the compressed gas out of the canister to fill the space between the two layers, such that the suit becomes buoyant and helps the wearer retain heat due to the insulating properties of air.

A further object of the invention deals with hazardous material stored in containers, upon which the device could be attached so as to keep the containers of hazardous waste from becoming irretrievably lost should they be lost at sea or into a deep lake or river.

An additional object of the invention is to use the inflation device in a throwable personal flotation device which could be made small and compact, for easy throwing over a longer distance than would be possible with a traditionally lightweight and bulky PFD, but when it hit the water it would automatically inflate to provide buoyancy in man overboard situations.

The invention has additional benefits when built into a box which can shield and protect valuable documents, such as log books, black boxes in airplanes, etc.

It is a final object of this invention that the invention be made of simple, easy to find, inexpensive components, such that it provides an economical means of ensuring that valuable items which fall into water are not lost.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE INVENTION

Figure 1:
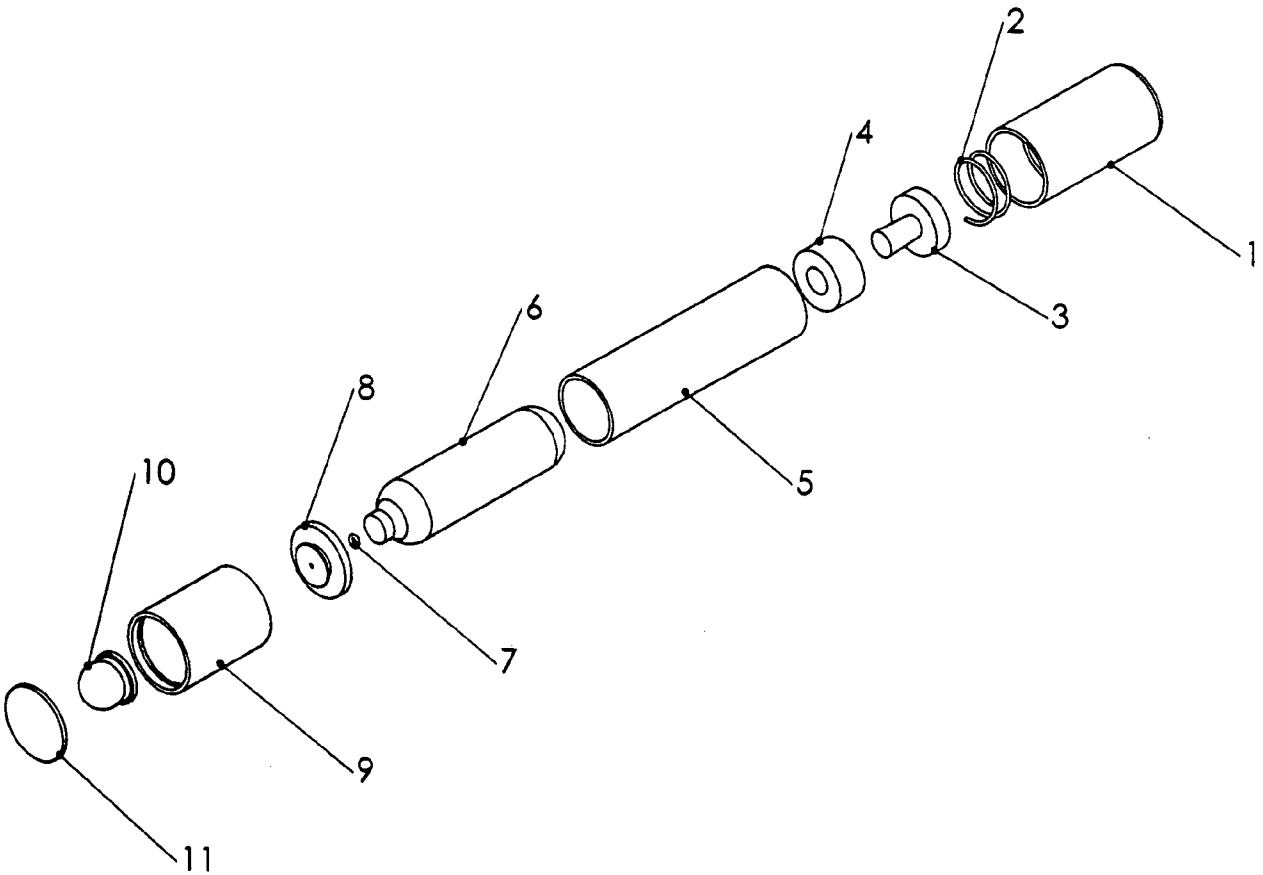
FIG. 1 is a front elevational, exploded view of the iteration of the invention most appropriate for the recreational boater, showing the various parts of the invention.

The invention has many iterations, but most iterations can be illustrated by the basic mechanism taught by FIG. 1. FIG. 1 is a front elevational, exploded view of the iteration of the invention most appropriate for the recreational boater, showing the various parts of the invention. The idea behind the invention is to provide a device which automatically punctures a compressed gas canister upon immersion in water, or upon a set time period of immersion in water or upon reaching a certain depth or water pressure, whereupon the compressed gas inflates a balloon or other inflatable device, causing the object to rise to the surface. Alternatively, in the case of retrieving an already sunken object, the device can be attached to the outside of the sunken object such that by inflating the device it adds external buoyancy to the sunken object to lift it to the surface, or, the device can be inserted into the inside of the sunken object such that it not only provides lift through buoyancy, but also displaces water already residing in the sunken object. For example, should a SCUBA diver drop a valuable anchor over the side of the boat, he/she could take a buoyancy device with a 5-minute activation "fuse", dive down the anchor in less than 5 minutes, attach the device to the anchor, and swim back to the surface to retrieve the anchor once the buoyancy device is activated.

Turning the FIG. 1, in this figure, there is a lower casing (1), with a bottom, into which a spring (2) fits, followed by a plunger (3) and a bobbin (4). The bobbin (4) is water soluble, such that once water enters the device and contacts the bobbin, the bobbin begins to disintegrate. The depth at which water may enter the device, and the rate at which the bobbin disintegrates upon contact with water are two factors that are adjusted for different iterations of the invention depending on the desired result. The lower casing (1) attaches to a casing (5), which houses the canister (6) of compressed gas, preferably carbon dioxide but it is contemplated that a wide range of compresses gasses could be effectively used. On the other end of the canister (5), there is an O-Ring (7) and a syringe (8) which has at least one part capable of puncturing the top of the canister. The bobbin (4) is the water-sensitive trigger: when the water eats through the bobbin, the spring (2) pushes the plunger (3) into the bottom of the canister (6), forcing the canister against the syringe (8), which "pops" the canister, causing compressed gas to escape the canister, which is sealed against the syringe (8) by the O-Ring (7) and flow into a balloon (10), housed in a balloon casing (9). The end of the invention is a cap (11), preferably of Mylar or some other material which is firm enough to retain a deflated balloon but which is easily pushed out by an expanding balloon. Once the balloon expands, the object to which the invention is attached floats to the surface.

In other iterations, a manufacturer need only change the sizes, composition, or other basic characteristics of the invention as laid out here, to affect the desired results. For example, in the iteration to fill holds in a submerged object or prevent the holds from filling with water, the trigger fuse is set longer, and canister is larger, and the balloon is larger and tougher. In the iteration in which the invention is used to prevent large objects from sinking, the trigger fuse is short but the canister is the same size and the balloon is also large and made of tough resilient material. The additional figures all illustrate different aspects of the invention in its different iterations.

For the iteration for a water sports user, the gas is compressed air and the trigger may be set to be sensitive to water, depth, or pressure.

Figure 2:
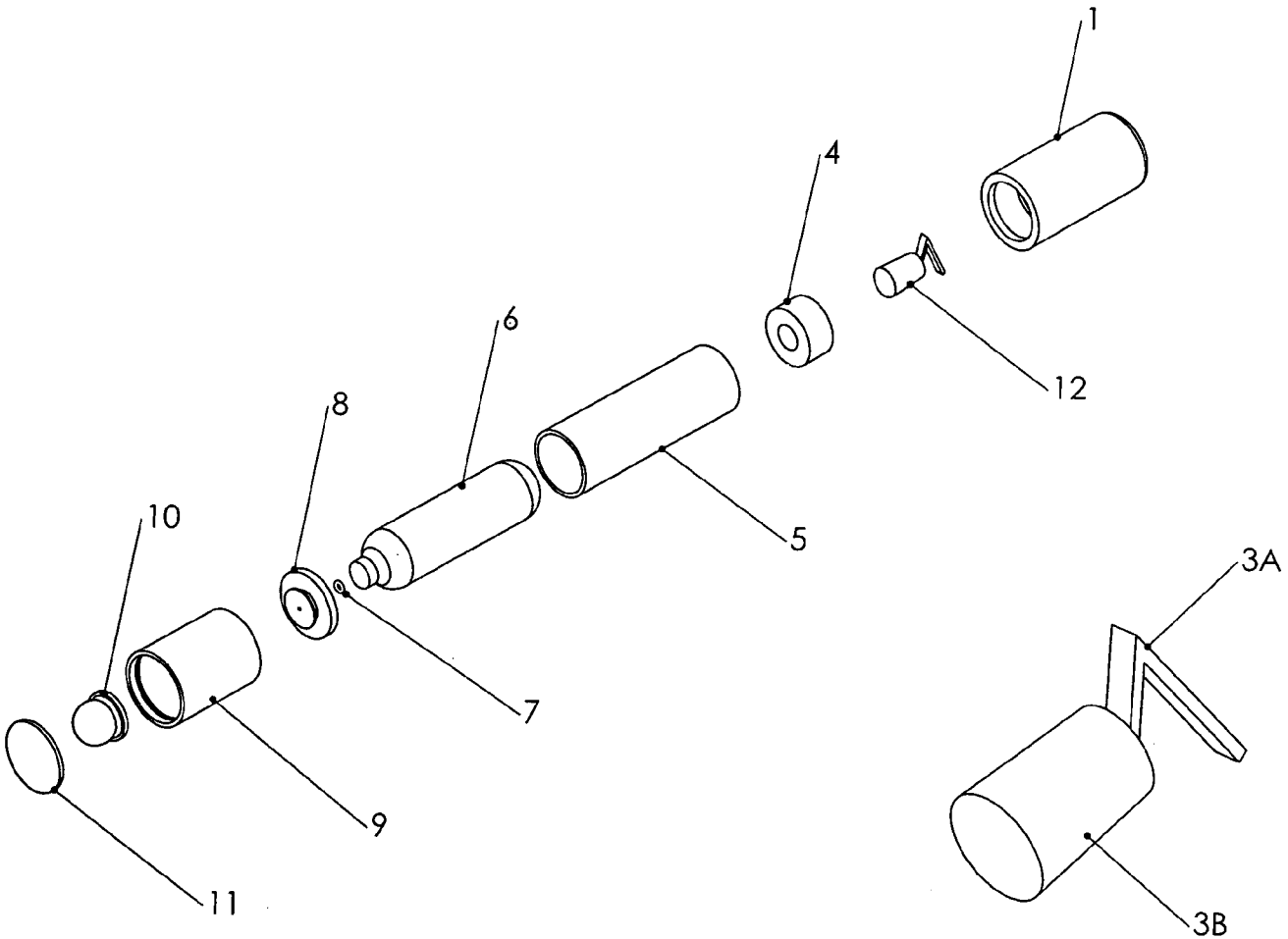
FIG. 2 is a front elevational, exploded view of the invention of FIG. 1 but without a spring and with a plunger angle to provide the pressure to the plunger.

FIG. 2 is a front elevational, exploded view of the invention of FIG. 1 but without a spring and with a plunger angle (3C) to provide the pressure to the plunger (3B). The spring and plunger angles are just two of the mechanisms contemplated to provide pressure, either directly or indirectly, to the canister (6) against the syringe (8).

Figure 3:
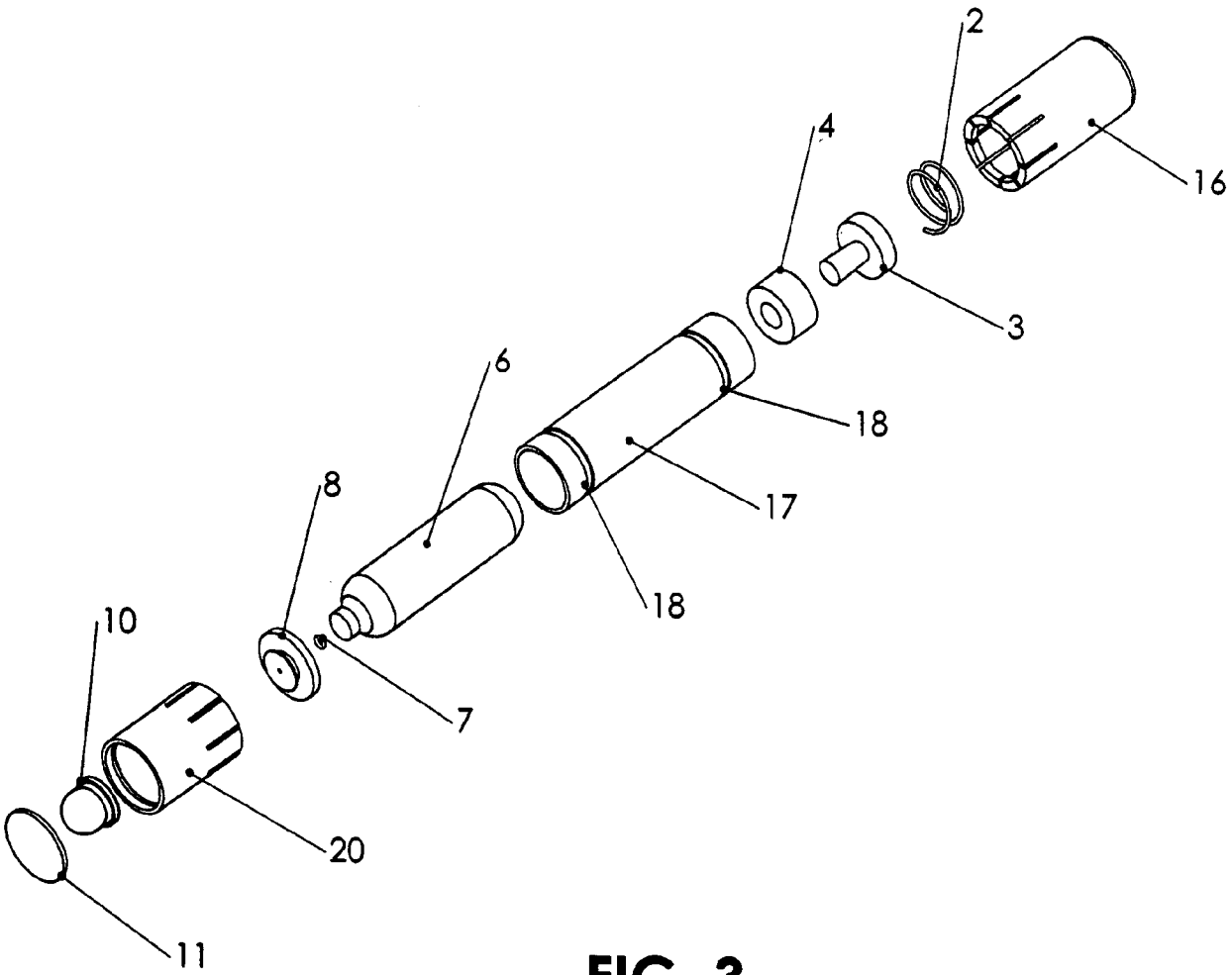
FIG. 3 is a front elevational, exploded view of the invention showing a housing unit which attaches by way of a snapping top and bottom.

FIG. 3 is a front elevational, exploded view of the invention showing a housing unit which attaches by way of a snapping top and bottom. Here, the bottom casing (16) has a solid bottom, a cylindrical side section, and an open top, and has a plurality of slits cut into the upper end of the cylindrical side section such that the upper end of the cylindrical side section is divided into two or more snapping members. Each snapping member has on its inside upper edge a snapping flange. The balloon casing (20) also has a cylindrical side section with an open bottom which has a plurality of slits cut into the lower end of the cylindrical side section such that the lower end of the cylindrical side section is divided into two or more snapping members. Each snapping member has on its inside upper edge a snapping flange. The central casing (17) has two snap rings (18): one on its lower portion and another on its upper portion. The bottom casing (16) and balloon casing (20) can be pressed toward each other, such that the snapping flanges on the bottom casing (16) and balloon casing (20) snap over the snap rings (18) on the central casing (17), thereby removably attaching the various components of the invention together within the cavity formed by the upper casing, casing, and lower casing.

Figure 4:
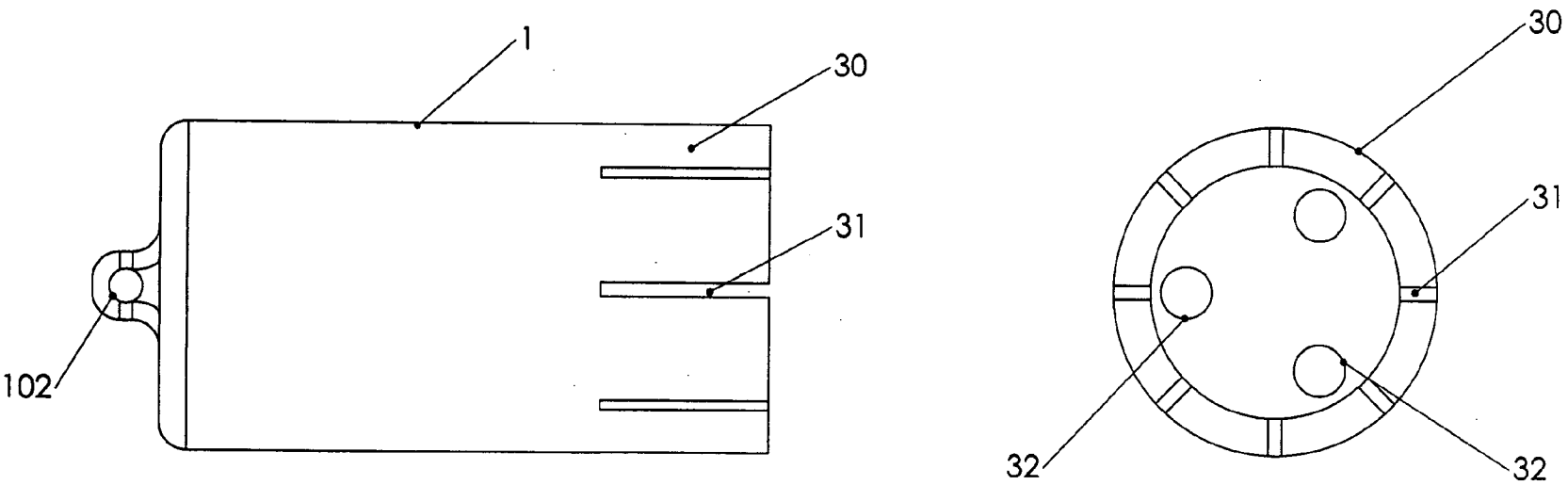
FIG. 4 is a side and bottom view of the snapping top.

FIG. 4 is a side and bottom view of the snapping bottom casing. At the bottom of the bottom casing (1) is an eyelet (102) in the top suitable for running a lanyard or keychain through to affix the device to an object the user of the invention wishes to be able to retrieve should it fall in the water. This figure shows how slits (31) cut into the upper end of the cylindrical side section cause the upper end of the cylindrical side section is divided into two or more snapping members (30). Looking into the open end of the bottom casing, a plurality of holes (32) are seen. These holes prevent a mere splash of water from dissolving the bobbin, but when the device is immersed in water, the water will quickly pour through the holes and begin dissolving the bobbin.

Figure 5:
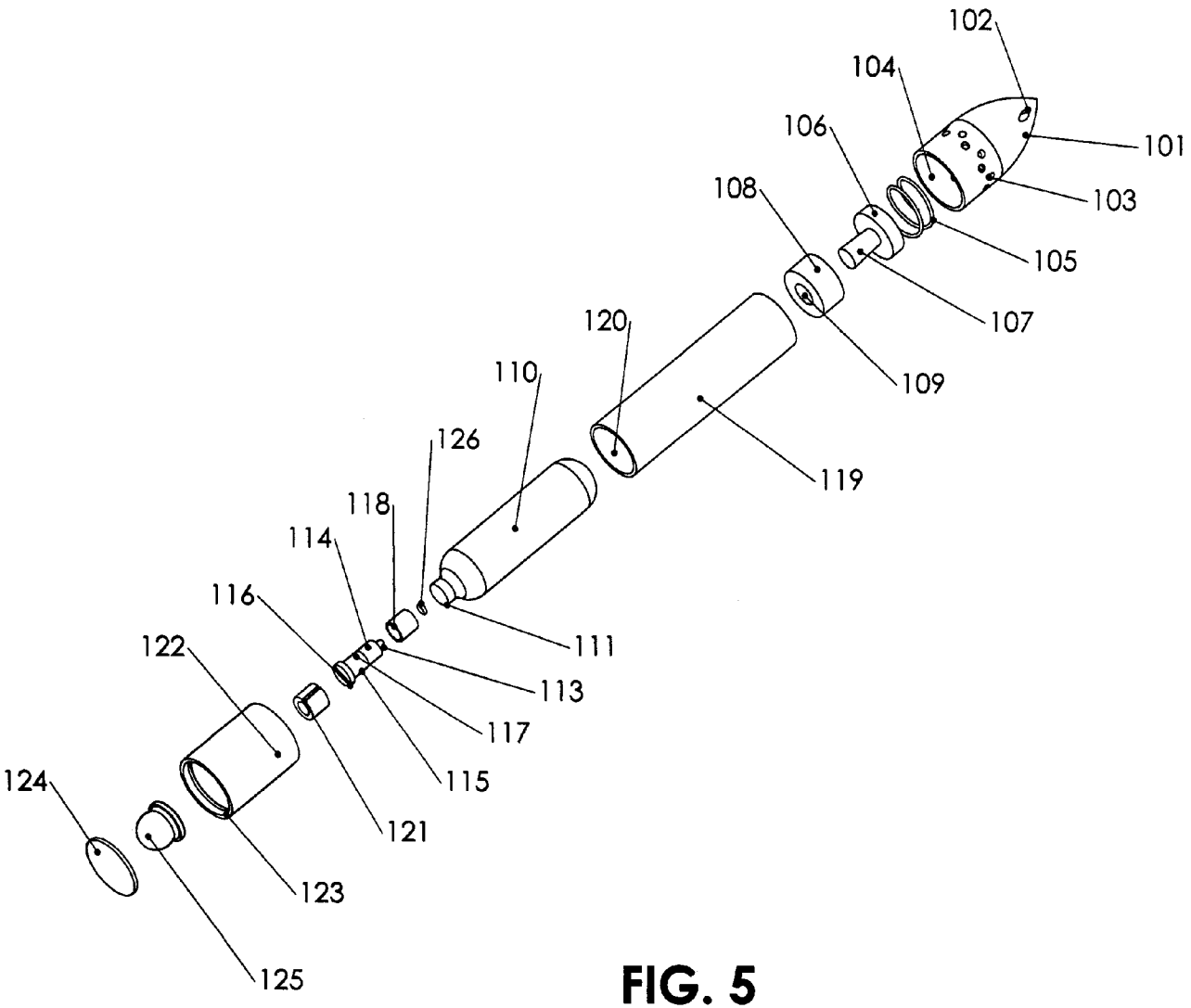
FIG. 5 is a front elevational, exploded view of the invention showing a top unit with an eyelet in the top suitable for running a lanyard or keychain and holes in the side which will allow water into the device.

FIG. 5 is a front elevational, exploded view of the invention showing a top unit with an eyelet (102) in the top (101) suitable for running a lanyard or keychain and holes (103) in the side which will allow water into the device. Here the top unit has a hollow cavity (104) into which a spring (105) and a plunger (106) sit. On the end of the plunger is a push rod (107) around which rests the bobbin (108). The bobbin (108) has some arrangement of water-soluble material or materials in the shape of donut, which a hole (109) in the center through which the push rod (107) slips. The bobbin (108) sits against a ridge in the inside of the casing (119), which is a hollow cylinder (120) into which the canister (110) fits. The bobbin (108) protects the canister (110) against the push rod (107) of the plunger (106). At the tip (111) of the canister is a flat area which can be perforated by the syringe (generally indicated by reference number 115). Holding the compressed gas within their boundaries and directing the compressed gas into the balloon (125) are an o-ring (126), a rubber valve (118), and a C-clamp (121) which hold the syringe (117) within the balloon casing (122). The syringe has a piercing needle (113) over which the o-ring (126) fits, a lower body portion (114) over which the rubber valve (118) fits, a gas outlet (115) through which the compressed gas escapes into the balloon, and a slotted top portion (135). On the upper interior surface of the balloon casing (122) is a ridge (123) against which the balloon (125) is secured. Capping the balloon (125) is a mylar cap (124) which is disgorged from the balloon casing (122) when the balloon (125) is inflated.

Figure 6:
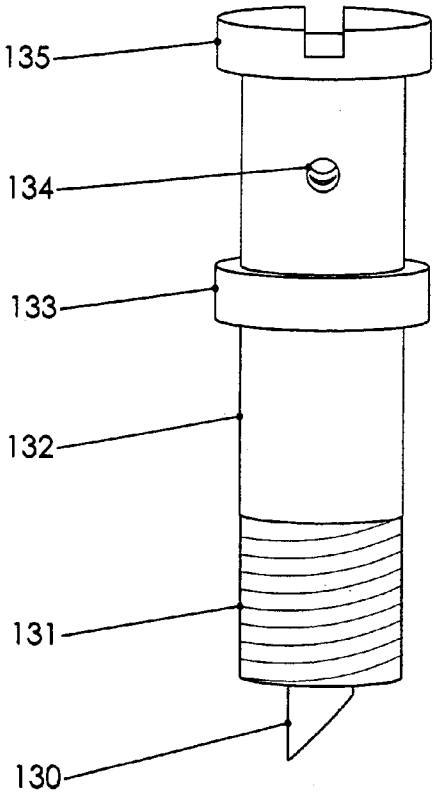
FIG. 6 shows one version of the syringe unit in greater detail.

FIG. 6 shows one version of the syringe unit in greater detail. The slotted top portion (135) allows a user the screw the syringe unit into the casing units, usually in most configurations envisioned by the inventors, the central casing. The slot in the top is larger than would be needed to accommodate the average screwdriver or edge of a coin, such that any overlying balloon will not be punctured as the user finds the slot and inserts the turning tool into the slot over the balloon. The gas outlet (134) allows gas from the punctured canister to exit the syringe into the balloon (not shown in the figure), which lays over the upper portion of the syringe down beyond the central ridge (133), where it is secured by a rubber valve and C-clamp (not shown in this figure. Below the central ridge (133) is the lower portion (132) of the syringe, which terminates in a threaded portion (131) and a piercing needle (130), which is hollow such that once it penetrates the top of the canister, the escaping compressed gas is funneled through the piercing needle (130) and out the gas outlet (134) into the balloon.

Figure 7:
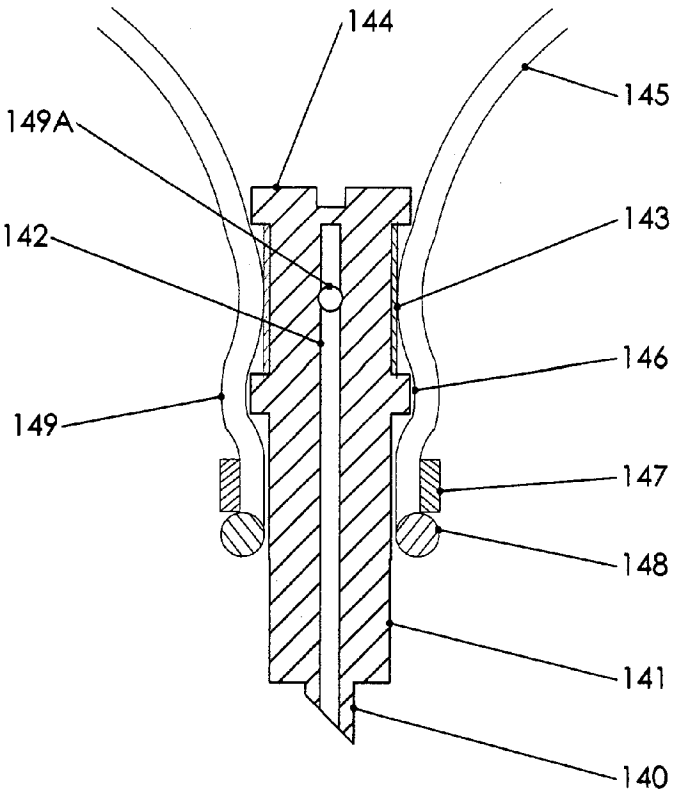
FIG. 7 shows a syringe unit with notched sides designed to hold a balloon in place.

FIG. 7 shows a syringe similar to that illustrated by FIG. 6, in cross sectional view, with notched sides designed to hold a balloon in place. Here, the syringe unit has a notched section (143) in between the central ridge (146) and slotted top portion (144). The notched section (143) allows compressed gas to pass through the hollow portion (142) of the piercing needle (140) through the gas outlet (149A) into the balloon (149), without having the sides of the balloon covering the gas outlet. The balloon is held in place or crimped against the syringe unit below the central ridge (146) by a variety of materials, including twist ties, hook and loop fasteners, or C-clamps. A general fastener (147) is illustrated here which holds the balloon against the syringe unit above the rolled end (148) of the balloon, such that when the balloon inflates, the internal air pressure does not cause the balloon to shoot upward, away from the syringe, thereby negating the positive buoyancy effect intended by the invention. Because the stem (149) of the balloon is stretch and bent over the central ridge (146), there are actually two restraints against escaping compressed gas exiting the bottom of the balloon.

Figure 8:
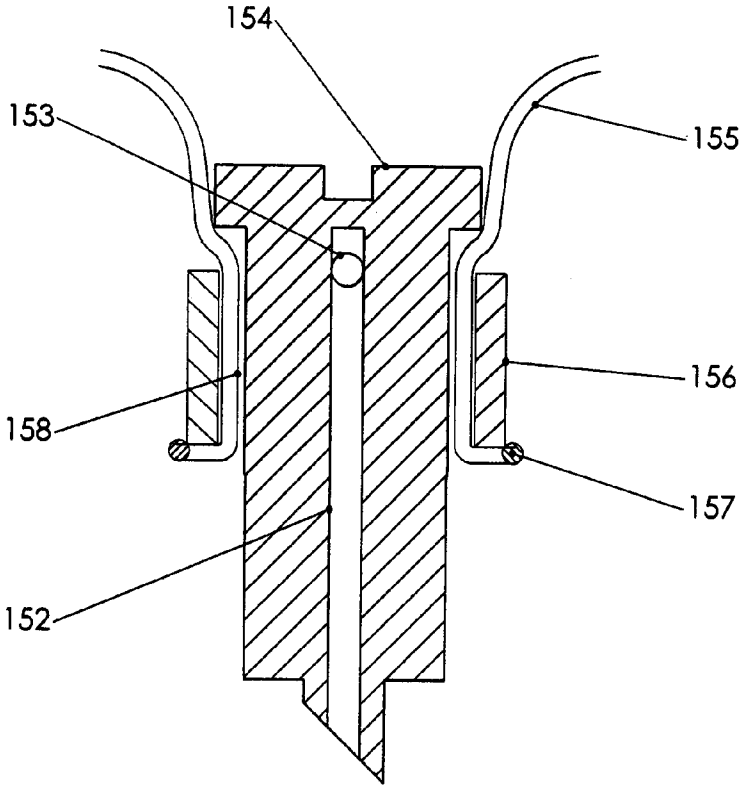
FIG. 8 shows a balloon being held in place by a C-clamp.

FIG. 8 shows a balloon (158) being held in place against the syringe unit by a C-clamp (156). Here, the syringe unit has a slotted top portion (154) and lacks a central ridge (146 in FIG. 7). The C-clamp (156) holds the balloon (155) against the side (151) of the syringe unit such that compressed gas travels through the central hollow chamber (152), exits the gas outlet (153) and fills the balloon. The rolled end (157) of the balloon is larger than the sides of the balloon (155), thus the C-clamp (156) effectively restrains the balloon (155) in place. Because the gas outlet (153) is higher than the C-clamp (156), the compressed gas will be directed into the balloon (155) and will not be lost through the end (157) of the balloon.

Figure 9:
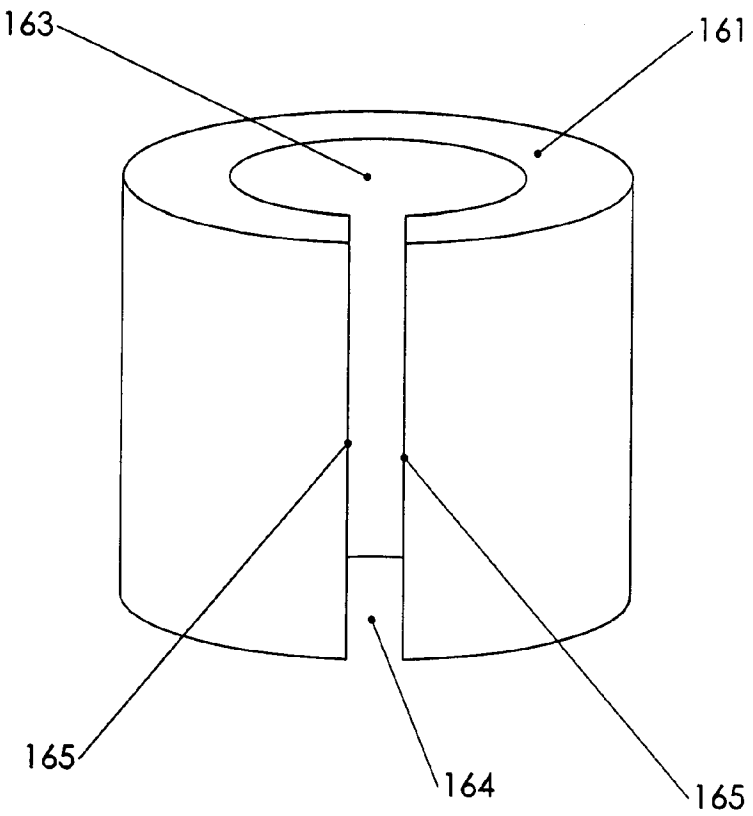
FIG. 9 is perspective view of a C-clamp.

FIG. 9 is a close-up, perspective view of the C-clamp of FIG. 8. The C-clamp is a cylindrical section of metal, plastic, or another similarly rigid yet somewhat flexible material which is flexible enough to bend outward at its two end sections (165) to slide over the syringe unit and balloon, and yet has a depth (161) thick enough to firmly hold the balloon against the side of the syringe unit such that the inflated balloon remains attached to the syringe unit rather than flying away and removing the buoyancy of the balloon from the device. The C-clamp has an open section (164) which gives it the flexibility to expand to fit over the syringe unit and the balloon, and is of a diameter to define a hollow cavity (163) of the size adequate to slide over the syringe unit and balloon.

Figure 10:
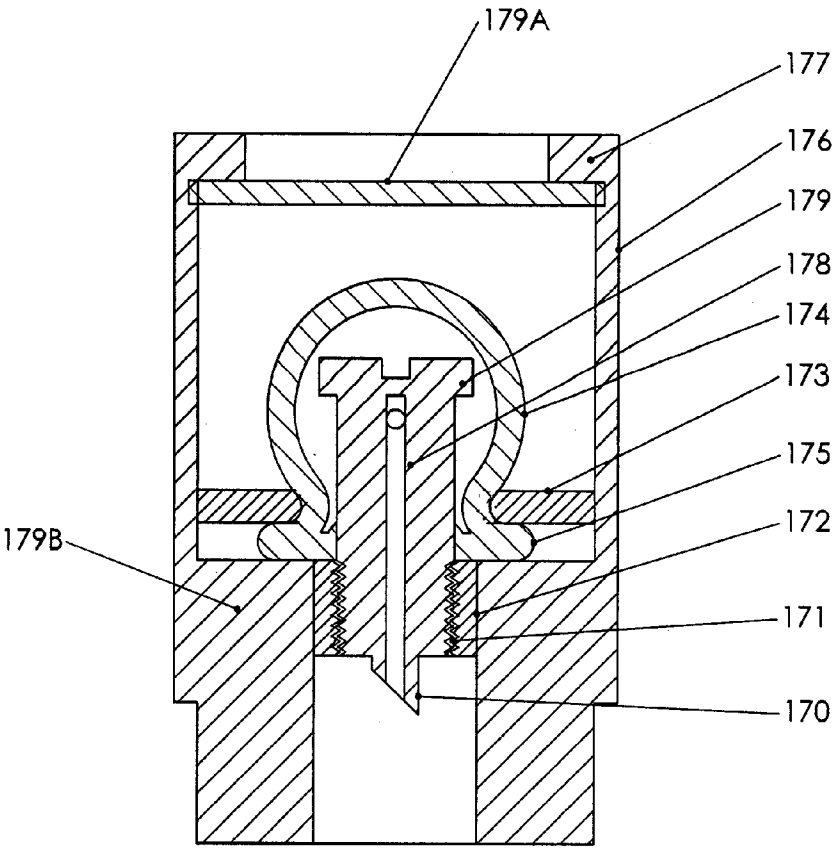
FIG. 10 shows another iteration of the puncture pin and balloon holding device.

FIG. 10 is a cross sectional view which shows another iteration of the syringe unit/puncture pin and balloon holding device. Here, the balloon casing (176) has an upper holding ring (177) which is a circular band of a diameter slightly smaller than the diameter of the balloon casing, which serves to hold the mylar cap (179A) in place when the balloon (174) is not inflated. The syringe unit, shown generally by reference number 179, is attached to the balloon casing by a means of attachment, which can vary from pressurized holding to snaps and screws. The means shown here, which is the preferred means, is to have screw threads (171) on the syringe unit screw into screw threat receptacles (172) which are built into the sides of the balloon casing. The balloon end (175) is crimped and forced against the central ridge (179B) of the balloon casing by a crimping device (173), which can be a C-clamp, twist tie, or even a rubber band. When the piercing needle (170) punctures the gas canister (not shown in this figure), the compressed gas exits the gas outlet (178) and fills the balloon (174). As the balloon expands, it pushed the mylar cap (179A) through the top of the balloon casing (176) and the balloon expands, providing the desired flotation.

Figure 11:
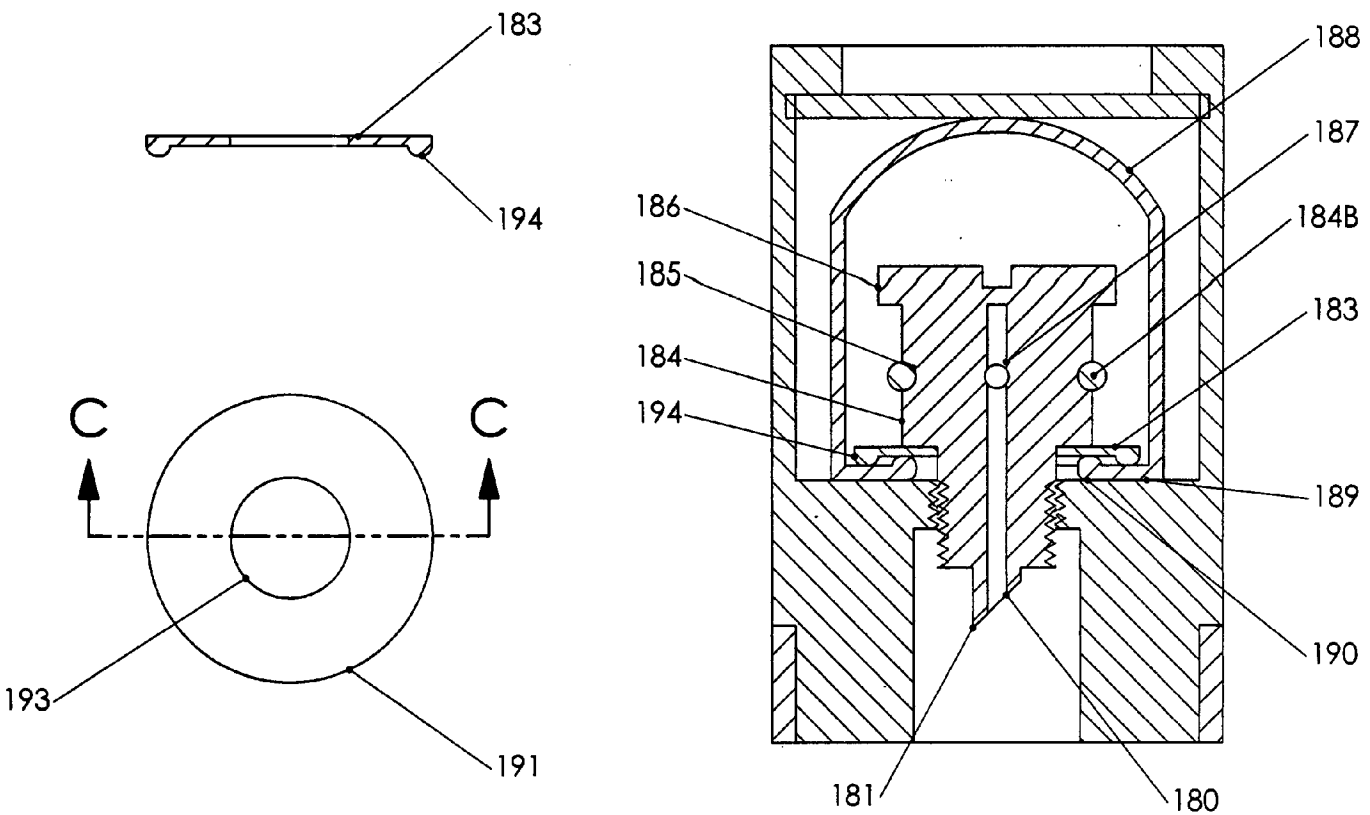
FIG. 11 shows yet another iteration of the puncture pin and balloon holding device.

FIG. 11 is a cross sectional view that shows yet another iteration of the puncture pin and balloon holding device. Here, the syringe body (184) has a slot (185) which extend around the outer circumference of the syringe body. ((This is confusing as the o-ring will cut off the flow of gas from the gas outlet)). To attach the balloon (188) to the balloon casing is a washer (183) with a downward projecting bulge (194) on its outer edge. The bulge (194) fits on the inner side of the balloon end (190) and clamps the balloon to the balloon casing as the syringe unit is screwed into the balloon casing. The washer (183) has an outer edge (191), which is of a circumference larger than the circumference of the balloon end (190), such that the balloon end can be stretched over the outer edge and the washer. The slot is "oversized" such that a user can easily line up a coin, thumbnail, screwdriver or other tool through the balloon to find the slot, then insert the turning device into the slot and screw the syringe unit into the central casing.

Figure 12:
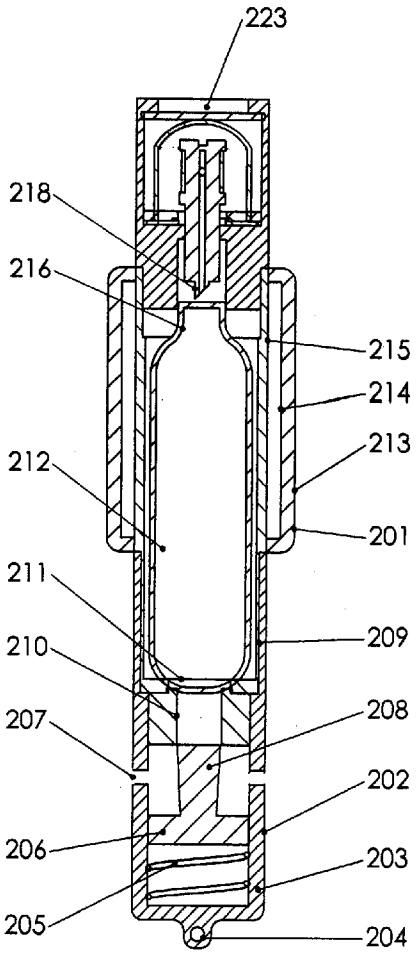
FIG. 12 is a cross sectional view of a further iteration of the device with side slots that can be used to tether the device to an item likely to be dropped into water.

FIG. 12 is a cross sectional view of a further iteration of the device with side slots that can be used to tether the device to an item likely to be dropped into water. The lower casing has an eyelet (204) through which a chain, lanyard or line can be strung. The lower casing also contains a coiled spring (205) and a plunger (206) with a push rod (208). There is a water-soluble bobbin (210) which prevents the coiled spring from uncoiling, and holes (207) through which water can pass. The canister (212) of compressed gas in this case rests on top of the bobbin, which is, in turn, held in place by the upper sections of the central casing. When the bobbin (241) dissolves sufficiently, it allows the coiled spring to uncoil, sending the plunger's push rod (208) crashing into the canister, forcing the canister up into the piercing needle (218) of the syringe unit. This figure also illustrates how side slots (213) can be incorporated into the lower casing, central casing, or upper casing, such that a belt or strap can be used to attach the device to a negatively buoyant object. The side slots (213) have a casing section (215) that is built into either the lower casing, central casing, or upper casing, with a handle portion (201) that connects the side slot with the casing section.

Figure 13:
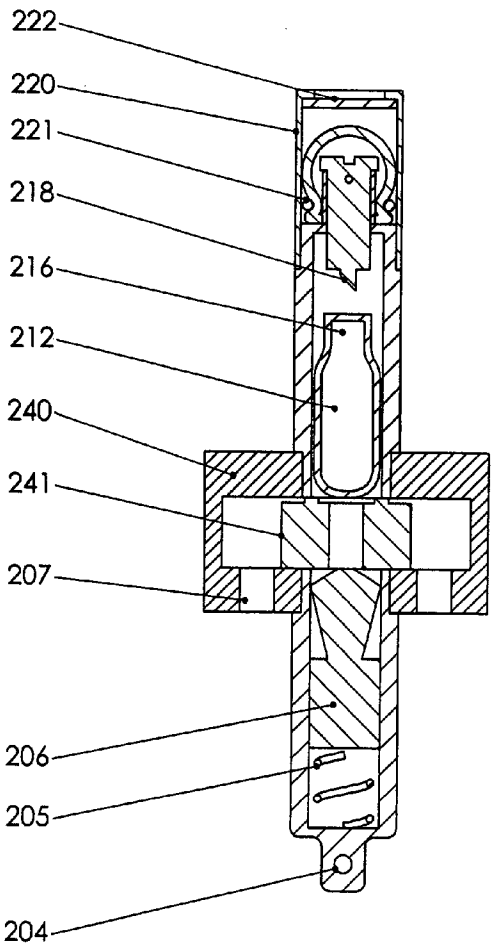
FIG. 13 is a cross sectional view of a keychain-sized version of the device, which would be used to retrieve keys, wallets, and other light items.

FIG. 13 is a cross sectional view of a keychain-sized version of the device, which would be used to retrieve keys, wallets, and other light items. The device has a lower casing with an eyelet (204) which contains a coiled spring (205) and a plunger (206). A middle casing (240) can be attached to the lower casing by a variety of means well know in the art. ((what keeps the plunger from flying up even with the bobbin in place?)). A bobbin (241) prevents the plunger from moving upward. The bobbin is water soluble and can be made from materials that dissolve in water at a certain rate to achieve a set time of immersion before the buoyancy device is triggered, or can be made of different thicknesses of water soluble materials to give the device different amounts of time before the device is activated. Water reaches the bobbin through one or more holes (207) made in the bottom side of the middle casing as dissolves the bobbin, thereby allowing the coiled spring (205) to uncoil, forcing the plunger (206) into the canister (212), which slams the canister into the piercing needle (218), which pierces the canister top (216). Compressed gas escapes from the canister into a balloon, which is secured to the syringe unit by a rubber band (221), C-clamp, or other means of attachment. The expanding balloon quickly fills the cavity of the balloon casing (220), which forces the top of the balloon against the mylar cap (222), forcing it through the opening in the top of the balloon casing, thereby allowing the balloon to inflate and provide the desired flotation. It should be noted that although this iteration of the invention is most suitable for tethering to a keychain or other small object, larger versions of the invention can be used to provide flotation for larger objects. In addition, a removable protective layer, such as a layer of adhesive tape, can be applied across the holes (207) such that a SCUBA diver can carry the device to an already submerged object, attach the device to the object, remove the tape and thereby allow the water to rush into the holes (207) and begin dissolving the bobbin (241), give the SCUBA diver a certain amount of time to clear the area before the balloon inflates (or in the case of using multiple devices, balloons inflate) and provide lift to the submerged object. Although the figures show a large variety of various means of attaching the device to an object, triggering the piercing of the canister, and locating the bobbin such that it allows the piercing of the canister only under certain conditions, the two basic uses for the device remain the same: raise submerged objects and provide rapid floatation to objects dropped overboard.

Figure 14:
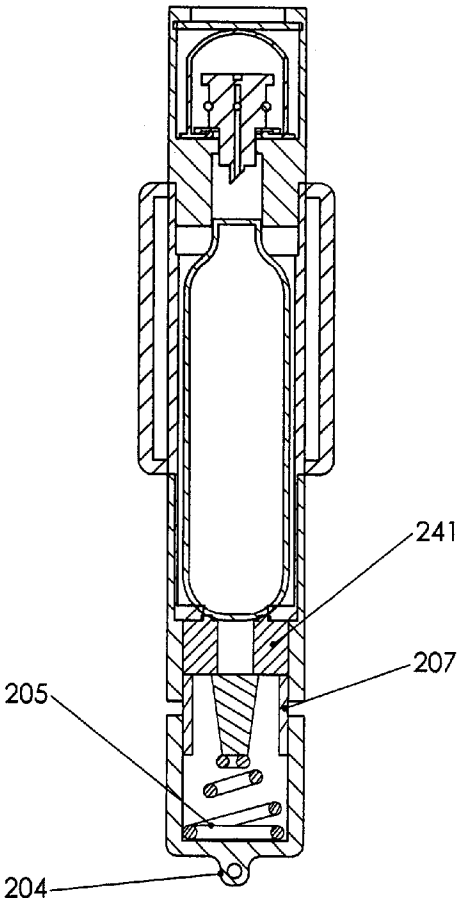
FIG. 14 shows yet another iteration of the invention.

FIG. 14 is a cross sectional view of an iteration of the invention with a rubber gasket (261) which prevents water from entering the device and triggering the canister until the device sinks to a certain depth. Here, water enters one or more holes (260) in the lower casing, but a rubber gasket (261) prevents that water from reaching the bobbin (262). The rubber gasket can be made of various types of rubber with different degrees of firmness and flexibility, and can be made with varying thicknesses of rubber, thereby giving the manufacturer of the invention two separate variables to adjust to create rubber gaskets that will let water through at certain water pressures. Therefore, a manufacturer of devices for key chains and other objects which are not intended to be thrown into the water would use a water gasket which will let water in at a very shallow depth, say, 10 centimeters, such that a mere splashing of water from a wave would not trigger the buoyancy mechanism but any substantial submersion of the object in water will allow the water to penetrate the device to the bobbin and begin dissolving the bobbin. Another iteration upon this theme would be to attach a device with a gasket which would let water penetrate upon a depth of 100 feet to a novice SCUBA diver, such that should the novice exceed the normal 60 feet recommended depth for novice divers, thereby causing a novice SCUBA diver who exceeds 100 feet to be forced back up to the surface. To lessen the danger of such forced decompression, the initial "100 foot" device could be fairly small, such that the diver's ascent was relatively slow. Additionally, a second device could be attached which would allow a larger balloon to inflate when the diver's air had run out (by feeding the diver's compressed air into the bobbin side of the device, such that when the diver's compressed air reached a certain low pressure, water was allowed in and a larger balloon immediately sent the diver to the surface (the rationale here being that even a sudden ascent with the danger of decompression problems would be preferable to almost certain death by drowning).

Figure 15:
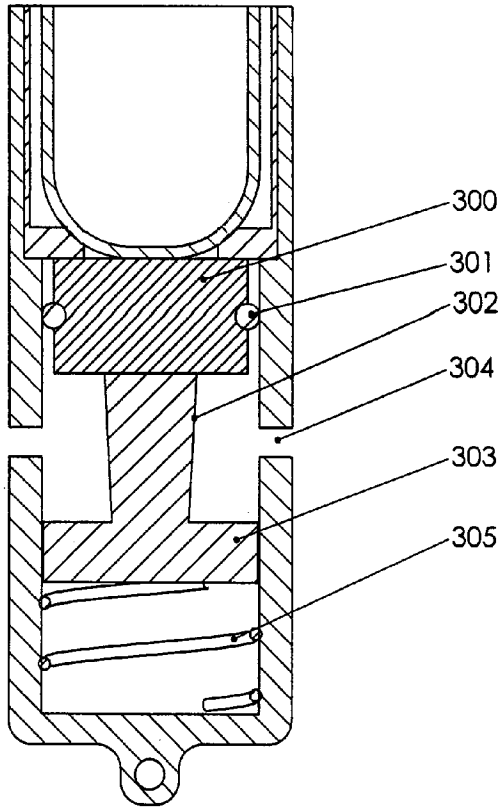
FIG. 15 is a cross sectional view of an iteration of the invention with a rubber gasket which prevents water from entering the device and triggering the canister until the device sinks to a certain depth.

FIG. 15 is a cross sectional view of an iteration of the invention where a water-soluble "pill" (300) is held in place by an o-ring (301) such that when exposed to water entering through holes (304) for a certain period of time, the pill dissolves, allowing the coiled spring (305) to uncoil, pushing the plunger (302) into the canister, thereby activating the balloon. It is also envisioned that a gasket-type device which prevents water from reaching the pill could be built into this iteration of the device by either plugging the holes (304) with a plastic, rubber or other compressible material with would be dislodged from the holes only upon reaching a certain water pressure (which could be correlated with a certain depth), or by lining the inside of the lower casing (306) under the holes with a band of plastic, rubber or other compressible material with would be forced away from the holes only upon reaching a certain water pressure (which could be correlated with a certain depth), whereupon the water could penetrate the inside of the lower casing (306) and begin dissolving the pill (300).

Figure 16:
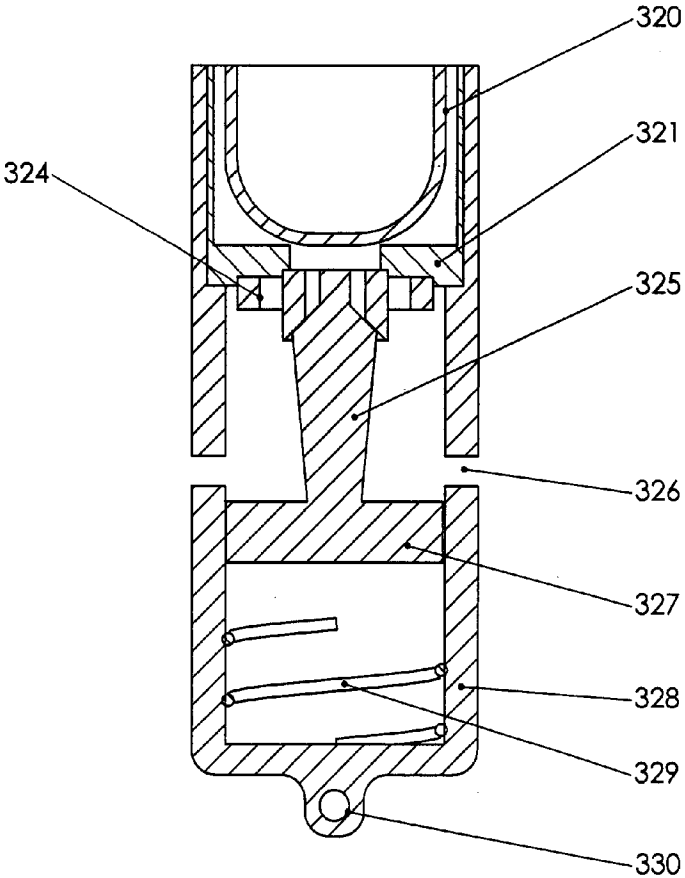
FIG. 16 is a cross sectional view of an iteration of the invention where a water-soluble "pill" is held in place by an o-ring such that when exposed to water for a certain period of time, the pill dissolves, allowing the syringe to puncture the canister, thereby activating the balloon.

FIG. 16 is a cross sectional view of another iteration of the invention where a ring of water-soluble material (324) holds the plunger (327) apart from the canister. In this version, the eyelet (330), lower casing (328), and coiled spring (329) all serve their traditional functions. The plunger push rod (325) has a pointed tip which nestles into a reverse-wedge shaped indentation in the ring of water-soluble material (324), which is held in place by a central casing ring (321). When the ring of water-soluble material (324) dissolves, the coiled spring (329) pushes the plunger (327) into the canister to drive the canister into the syringe unit (not shown in this figure).

Figure 17:
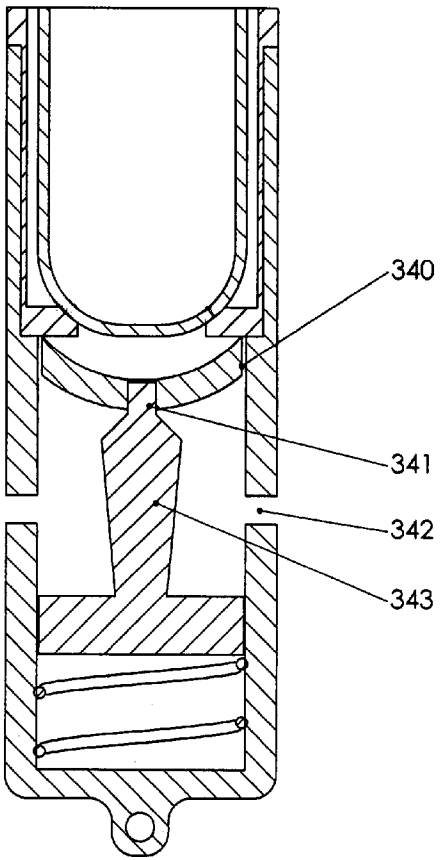
FIG. 17 is a cross sectional view of another iteration of the invention where a ring of water-soluble material holds the plunger apart from the canister.

FIG. 17 is a cross sectional view of a further iteration of the invention where an arch (340) of water soluble material is held in place by a keystone (341) projecting from the plunger, where the arch offers a strong means of restraining the plunger (343) relative to the amount of water soluble material used due to its architecture. Water can enter through holes (342) and begin dissolving the arch (340).

Figure 18:
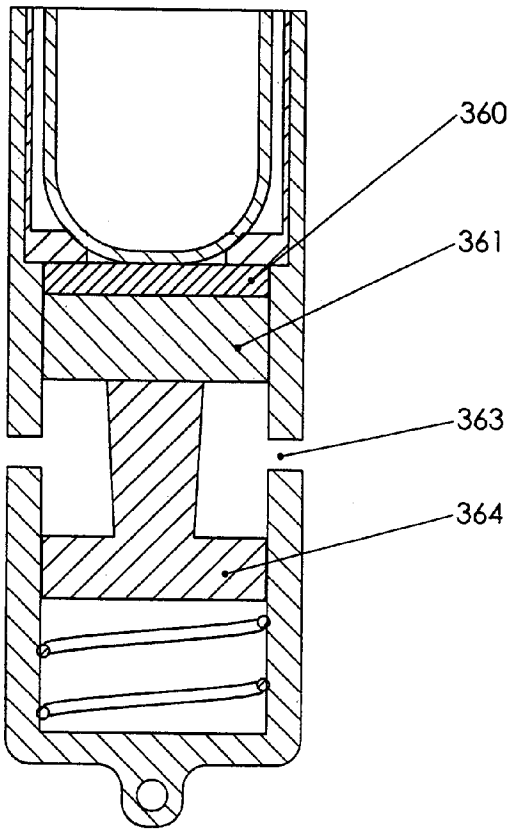
FIG. 18 is a cross sectional view of a further iteration of the invention where an arch of water soluble material is held in place by a keystone projecting from the syringe, where the arch offers a strong means of restraining the syringe relative to the amount of water soluble material used.

FIG. 18 is a cross sectional view of a final iteration of the invention where a layer of absorbent material protects a plunger-retaining layer from splashes of water. In this figure, a layer of sand (361) and a layer of rigid yet-water malleable paper (360) separates the plunger (364) from the canister, such that when a bit of water splashes on the device, the sand (361) absorbs the splash and the water does not penetrate to the paper layer (360), but when the device is dumped into water, the water quickly penetrates the layer of sand and permeates the layer of paper, thereby rendering the layer of paper malleable such that the coil-powered syringe pushes through the weakened layer of paper and punctures the canister. This iteration is also envisioned as having a further layer of water-soluble material is conjunction with the layers of sand and paper, or in conjunction with either a layer of sand or a layer of paper.

It is also envisioned that not only shall this invention be patentable as a product, but also as a means or method to perform the aforementioned goals and results.

Other uses shall be apparent to one skilled in the art, all of which we claim as our invention.

We claim:

1. A device for providing buoyancy to a negatively buoyant object, comprising:

a lower casing which comprises a hollow cylinder with a solid bottom end, the hollow cylinder defining a cavity in which rests a plunger, means of maintaining pressure between the lower casing and the plunger, a bobbin which is water-soluble, where the bobbin is designed and manufactured to disintegrate upon contact with water and where the bobbin is configured to maintain the means of maintaining pressure between the lower casing and the plunger until it is at least partially disintegrated upon contact with water, and a triggering mechanism that controls when water will be allows to come into contact with the bobbin, a central casing which is a cylinder which defines a cavity, a canister filled with a compressed gas, a syringe unit with means of puncturing the canister, means of directing the compressed gas released from the canister to a gas outlet, where the canister, the o-ring, and the syringe unit can be inserted into the cavity of the central casing, a balloon casing, a balloon with an inflatable portion and a bottom portion, where the bottom portion has a rolled lip which is thicker than the inflatable portion of the balloon, means of attaching the balloon to the syringe unit, and an end cap, where the balloon and the means for attaching the balloon to the syringe unit can be inserted into the balloon casing, one or more holes between the inside of the device and the outside of the device through which water can pour when the object is submerged in water, where, the top of the syringe unit can be brought into contact with the means of attaching the balloon to the syringe unit when the central casing and balloon casing are connected to each other, where, there are means to secure the lower casing, middle casing, and balloon casing together into one unit, where, when the bobbin disintegrates, the means of maintaining pressure between the lower casing and the plunger causes the plunger to contact the canister, which causes the canister to move up and be punctured by the syringe unit, whereupon the compressed air in the canister exits the canister and fills the balloon, thereby providing buoyancy for the object.

2. The device of claim 1, where the lower casing additionally comprises a solid bottom, a cylindrical side section with an upper end, and an open top, and a plurality of slits in the upper end of the cylindrical side section such that the upper end of the cylindrical side section is divided into two or more snapping members, where each snapping member has on an inside upper edge a snapping flange, and where the balloon casing additionally comprises a cylindrical side section with a lower end, and an open bottom end, and a plurality of slits in the lower end of the cylindrical side section such that the lower end of the cylindrical side section is divided into two or more snapping members, where each snapping member has on an inside upper edge a snapping flange, and where the central casing has two snap rings, one on its lower portion which can mate with the snapping flanges of the lower casing, and another on its upper portion which can mate with the snapping flanges balloon casing, and where the bottom casing and the balloon casing can be pressed toward each other, such that the snapping flanges on the bottom casing and balloon casing snap over the snap rings on the casing, thereby removably attaching the bottom casing and the balloon casing to the central casing.

3. The device of claim 1, additionally comprising an eyelet on one end of the device through which a line or lanyard can be run to secure the device to an object.

4. The device of claim 1, additionally comprising one or more side slots through which a line, lanyard, or belt can be run to secure the device to an object.

5. The device of claim 1, where the means of maintaining pressure between the lower casing and the plunger is a spring.

6. The device of claim 1, where the means of maintaining pressure between the lower casing and the plunger is a plunger angle.

7. The device of claim 1, where the bobbin is donut shaped, with a cylinder of water-soluble material surrounding a central hollow core, and where the plunger additionally comprises a push rod which extends from the plunger and fits into the central hollow core of the bobbin.

8. The device of claim 1, where the bobbin is pill shaped, and optionally, held in place by an o-ring.

9. The device of claim 1, where the bobbin is wedge-shaped, and the central casing additionally comprises one or more edges which project inward from the inner circumference of the central casing and have tapered ends, such that the wedged-shaped bobbin fits between the tapered ends and the plunger and jams the plunger from moving into the canister until the bobbin is at least partially disintegrated by water.

10. The device of claim 1, where the bobbin is arched-shaped with a keystone-shaped opening, and where the plunger additionally comprises a push rod with an upper end shaped like a keystone, where the end of the push rod fits into the keystone-shaped opening.

11. The device of claim 1, where the triggering mechanism that controls when water is allowed to come into contact with the bobbin is exceeding a certain water pressure.

12. The device of claim 11, where the triggering mechanism is one or more plugs of a compressible material that is jammed into the one or more holes such that the one or more plugs are pushed through the one or more holes only when a certain water pressure is exceeded.

13. The device of claim 11, where the triggering mechanism is a gasket of a compressible material located between the source of water and the bobbin, which allows water through only when a certain water pressure is exceeded.

14. The device of claim 1, where the syringe unit comprises a slotted top portion, gas outlet, a hollow piercing needle, a central hollow core which connects the hollow piercing needle to the gas outlet, a means of retaining the balloon in a position where bottom of the balloon is attached to the syringe unit below the gas outlet, such that when the canister is punctured by the hollow piercing needle, the compressed gas escapes the canister through the central hollow core and exits the gas outlet, whereupon the compressed gas fills the balloon.

15. The device of claim 1, where the syringe unit additionally comprises an o-ring and a rubber valve which surround the hollow piercing needle such that when the hollow piercing needle punctures the canister, the o-ring and the rubber valve prevent the compressed gas from escaping from the canister through a device other than the central hollow core of the hollow piercing needle, and screw threads, and where the central casing additionally comprises screw threads which mate with the screw threads on the syringe unit, such that the syringe unit can be screwed into the central casing to secure the syringe unit to the central casing.

16. The device of claim 1, where the syringe unit additionally comprises a central ridge, over which the bottom of the balloon can be pushed, and additionally comprising means for securing the bottom of the balloon below the central ridge, said means for securing the bottom of the balloon below the central ridge being selected from a group consisting of a rubber band, a C-clamp, a washer, and a twist tie, and screw threads, where the central casing additionally comprises screw threads which mate with the screw threads on the syringe unit, such that the syringe unit can be screwed into the central casing to secure the syringe unit to the central casing.

17. The device of claim 1, where the object is a sunken object with one or more holds, and the invention is inserted into the holds and inflated, such that the balloons inside the holds expand, expelling water in the hold and adding positive buoyancy to the object, thereby causing the object to float up to the surface of the water.

18. The device of claim 1, where the invention is designed to be manufactured as part of an automobile, train, truck, airplane, helicopter, or boat, or retrofitted into such an object, such that when a hold in which the invention is located receives water the balloon inflates, filling the available space in the hold, thereby preventing additional water from entering and expelling what water has already entered the hold.

19. The device of claim 1, where the compressed gas is air, and the invention is manufactured as part of an item of water sports clothing or retrofitted into such an item, such that when the invention is exposed to certain conditions, such as water, water pressure, or water depth, the bobbin disintegrates and compressed air from the canister fills a breathing apparatus which also serves as a flotation device.

20. The device of claim 1, where the device is built into a suit designed for use in the water, such as but not limited to diving, surfing, kayaking, and fishing suits, built of more than one layer, where the canister fills a space between two or more layers of the suit, such that the suit attains additional buoyancy and the air between the layers serves as a thermal insulator to protect the user against cold water.

21. The device of claim 1, where the device is attached to a personal flotation device and triggered by the PFD hitting the water, such that the compressed gas is released into the balloon upon the PFD hitting the water, thereby providing buoyancy to a person grabbing onto the now-inflated PFD.

22. The device of claim 1, where the device is built into a box which houses one or more valuable items, such as logbooks or black boxes, such that when the box is exposed to water the inflation mechanism is triggered, thereby causing the box and its valuable contents to remain floating.

23. The device of claim 1, where the device is built into or attached to fishing items, such as fishing lines, crab traps, fishing and shrimping nets, and other fishing devices, such that the invention can be remotely triggered to facilitate recovery of the trap, line, or net.

24. A method of providing buoyancy to a negatively buoyant object on dry land, comprising the steps of:

first, obtaining a device for providing buoyancy to a negatively buoyant object, the device comprising:

a lower casing which comprises a hollow cylinder with a solid bottom end, the hollow cylinder defining a cavity in which rests a plunger, means of maintaining pressure between the lower casing and the plunger, a bobbin which is water-soluble, where the bobbin is designed and manufactured to disintegrate upon contact with water and where the bobbin is configured to maintain the means of maintaining pressure between the lower casing and the plunger until it is at least partially disintegrated upon contact with water, and a triggering mechanism that controls when water will be allows to come into contact with the bobbin, a central casing which is a cylinder which defines a cavity, a canister filled with a compressed gas, a syringe unit with means of puncturing the canister, means of directing the compressed gas released from the canister to a gas outlet, where the canister, the o-ring, and the syringe unit can be inserted into the cavity of the central casing, a balloon casing, a balloon with an inflatable portion and a bottom portion, where the bottom portion has a rolled lip which is thicker than the inflatable portion of the balloon, means of attaching the balloon to the syringe unit, and an end cap, where the balloon and the means for attaching the balloon to the syringe unit can be inserted into the balloon casing, one or more holes between the inside of the device and the outside of the device through which water can pour when the object is submerged in water, where, the top of the syringe unit can be brought into contact with the means of attaching the balloon to the syringe unit when the central casing and balloon casing are connected to each other, where, there are means to secure the lower casing, middle casing, and balloon casing together into one unit, where, when the bobbin disintegrates, the means of maintaining pressure between the lower casing and the plunger causes the plunger to contact the canister, which causes the canister to move up and be punctured by the syringe unit, whereupon the compressed air in the canister exits the canister and fills the balloon, thereby providing buoyancy for the object, second, attaching the device to a negatively buoyant object on dry land, third, taking the negatively buoyant object onto a boat.

25. A method of providing buoyancy to a negatively buoyant object found underwater, comprising the steps of:

first, obtaining a device for providing buoyancy to a negatively buoyant object, the device comprising:

a lower casing which comprises a hollow cylinder with a solid bottom end, the hollow cylinder defining a cavity in which rests a plunger, means of maintaining pressure between the lower casing and the plunger, a bobbin which is water-soluble, where the bobbin is designed and manufactured to disintegrate upon contact with water and where the bobbin is configured to maintain the means of maintaining pressure between the lower casing and the plunger until it is at least partially disintegrated upon contact with water, and a triggering mechanism that controls when water will be allows to come into contact with the bobbin, a central casing which is a cylinder which defines a cavity, a canister filled with a compressed gas, a syringe unit with means of puncturing the canister, means of directing the compressed gas released from the canister to a gas outlet, where the canister, the o-ring, and the syringe unit can be inserted into the cavity of the central casing, a balloon casing, a balloon with an inflatable portion and a bottom portion, where the bottom portion has a rolled lip which is thicker than the inflatable portion of the balloon, means of attaching the balloon to the syringe unit, and an end cap, where the balloon and the means for attaching the balloon to the syringe unit can be inserted into the balloon casing, one or more holes between the inside of the device and the outside of the device through which water can pour when the object is submerged in water, where, the top of the syringe unit can be brought into contact with the means of attaching the balloon to the syringe unit when the central casing and balloon casing are connected to each other, where, there are means to secure the lower casing, middle casing, and balloon casing together into one unit, where, when the bobbin disintegrates, the means of maintaining pressure between the lower casing and the plunger causes the plunger to contact the canister, which causes the canister to move up and be punctured by the syringe unit, whereupon the compressed air in the canister exits the canister and fills the balloon, thereby providing buoyancy for the object, second, entering the water in which the negatively buoyant object is located, third, attaching the device to a negatively buoyant object, fourth, waiting until the device activates and provides buoyancy to the negatively buoyant object, fifth, retrieving the negatively buoyant object when it floats to the surface of the body of water.

* * * * *